US011655949B2

(12) United States Patent
Huang

(10) Patent No.: US 11,655,949 B2
(45) Date of Patent: May 23, 2023

(54) CLAMPING LAMP AND LIGHT CONTROLLING METHOD APPLYING THE SAME

(71) Applicant: Qisda Corporation, Taoyuan (TW)

(72) Inventor: Chih-Lung Huang, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/552,402

(22) Filed: Dec. 16, 2021

(65) Prior Publication Data

US 2022/0196216 A1 Jun. 23, 2022

(30) Foreign Application Priority Data

Dec. 23, 2020 (CN) ..... 202011537351.8

(51) Int. Cl.
*F21S 6/00* (2006.01)
*F21V 19/00* (2006.01)
(Continued)

(52) U.S. Cl.
CPC ..... *F21S 6/003* (2013.01); *F21V 19/008* (2013.01); *F21V 21/008* (2013.01);
(Continued)

(58) Field of Classification Search
CPC .... F21V 21/088; F21V 21/0885; F21V 21/26; F21V 21/28; F21V 21/29; F21V 21/30;
(Continued)

(56) References Cited

U.S. PATENT DOCUMENTS 5,379,201 A * 1/1995 Friedman ..... F21V 33/0052 362/253
10,731,833 B2 * 8/2020 Tsai ..... F21V 23/0464
(Continued)

FOREIGN PATENT DOCUMENTS

CN 104832812 A 8/2015
CN 107238015 A * 10/2017 ..... F21S 6/002
(Continued)

OTHER PUBLICATIONS

Machine translation of CN 111947089 A retrieved from FIT database of PE2E Search. (Year: 2022).*
(Continued)

*Primary Examiner* — Colin J Cattanach

(57) ABSTRACT

A clamping lamp for clamping a monitor comprises a first light source and a clamping body including a second light source, a first clamping component including a first clamping portion and a lamp connection portion, and a second clamping component including a second clamping portion. The lamp connection portion connects with the first clamping portion and the first light source. The first clamping portion leans against a front surface of the monitor and the second clamping portion leans against a back surface of the monitor when the clamping lamp clamps the monitor so the first light source is located above a top surface of the monitor. The first light source emits light toward a first zone that the front surface faces toward. The second light source emits light toward a second zone that the back surface faces toward.

19 Claims, 6 Drawing Sheets

(51) Int. Cl.

| | |
|---|---|
| ***F21V 21/088*** | (2006.01) |
| ***F21V 21/008*** | (2006.01) |
| ***F21L 4/02*** | (2006.01) |
| ***F21V 23/04*** | (2006.01) |
| ***F21L 4/04*** | (2006.01) |
| ***F21V 21/26*** | (2006.01) |
| ***F21V 21/30*** | (2006.01) |
| ***F21V 21/29*** | (2006.01) |
| ***F21V 21/28*** | (2006.01) |

(52) U.S. Cl.
CPC ..... *F21V 21/0885* (2013.01); *F21L 4/02* (2013.01); *F21L 4/022* (2013.01); *F21L 4/025* (2013.01); *F21L 4/027* (2013.01); *F21L 4/04* (2013.01); *F21L 4/045* (2013.01); *F21V 21/26* (2013.01); *F21V 21/28* (2013.01); *F21V 21/29* (2013.01); *F21V 21/30* (2013.01); *F21V 23/045* (2013.01); *F21V 23/0442* (2013.01); *F21V 23/0464* (2013.01); *F21V 23/0471* (2013.01)

(58) Field of Classification Search
CPC ..... F21V 23/045; F21V 23/0471; F21V 23/0464; F21V 23/0442; F21L 4/02; F21L 4/022; F21L 4/025; F21L 4/027; F21L 4/04; F21L 4/045
See application file for complete search history.

(56) References Cited

U.S. PATENT DOCUMENTS

| | | | | |
|---|---|---|---|---|
| 2003/0147206 | A1* | 8/2003 | Chen | F16M 11/14 361/679.55 |
| 2004/0047152 | A1* | 3/2004 | Hung | B60Q 3/275 362/240 |
| 2015/0084515 | A1* | 3/2015 | Altamura | H05B 45/20 315/131 |
| 2015/0102731 | A1* | 4/2015 | Altamura | A47G 33/0836 315/152 |
| 2016/0360585 | A1* | 12/2016 | Urry | F21V 33/00 |
| 2018/0363889 | A1* | 12/2018 | Yen | F21V 21/088 |
| 2019/0274206 | A1* | 9/2019 | Altamura | F21V 23/003 |

FOREIGN PATENT DOCUMENTS

| | | | | |
|---|---|---|---|---|
| CN | 209484341 | U | * 10/2019 | |
| CN | 111853601 | A | * 10/2020 | F21S 8/00 |
| CN | 111947089 | A | * 11/2020 | |
| CN | 112682766 | A | * 4/2021 | |
| TW | 201809832 | A | 3/2018 | |
| TW | I623925 | B | 5/2018 | |
| TW | 201905380 | A | 2/2019 | |

OTHER PUBLICATIONS

Office action of counterpart application by Taiwan IP Office dated Aug. 19, 2021.

* cited by examiner

CLAMPING LAMP AND LIGHT CONTROLLING METHOD APPLYING THE SAME

This application claims the benefit of People's Republic of China application Serial No. 202011537351.8, filed Dec. 23, 2020, the subject matter of which is incorporated herein by reference.

BACKGROUND OF THE INVENTION

Field of the Invention

The invention relates in general to a clamping lamp, and more particularly to a clamping lamp that is able to clamp a monitor.

Description of the Related Art

Sometimes, only the lighting in front of the monitor is provided when the monitor is used. At this time, there is a great brightness difference between the display screen brightness of the monitor plus the environment brightness and the illuminance of the wall behind the monitor. This causes that a user is prone to be fatigued due to the high brightness contrast. In view of this, it is necessary to propose a new lamp for a monitor to solve the problem.

SUMMARY OF THE INVENTION

The invention relates in general to a clamping lamp for clamping a monitor and a light controlling method applying the same, thereby providing a beneficial eye-protection effect when people looks at a screen of the monitor.

According to a first aspect of the present invention, a clamping lamp for clamping a monitor is provided. The monitor has a front surface, a back surface and an top surface connecting with the front surface and the back surface. The clamping lamp comprises a first light source and a clamping body. The clamping body comprises a second light source, a first clamping component and a second clamping component. The first clamping component includes a first clamping portion and a lamp connection portion connecting with the first clamping portion. The lamp connection portion connects with the first light source. The second clamping component includes a second clamping portion. The first clamping portion is configured to lean against the front surface and the second clamping portion is configured to lean against the back surface when the clamping lamp clamps the monitor, such that the first light source is located above the top surface and the second light source is located below the top surface. The first light source is configured to emit light toward a first zone that the front surface faces toward when the first light source is turned on. The second light source is configured to emit light toward a second zone that the back surface faces toward when the second light source is turned on. A plane formed by a periphery of the second clamping portion that is adjacent to the second light source is substantially parallel to the front surface when the clamping lamp clamps the monitor.

According to a second aspect of the present invention, another clamping lamp for clamping a monitor is provided. The monitor has a front surface, a back surface and an top surface connecting with the front surface and the back surface. The clamping lamp comprises a first light source and a clamping body. The clamping body comprises a second light source, a first clamping component and a second clamping component. The first clamping component includes a first clamping portion and a lamp connection portion connecting with the first clamping portion. The lamp connection portion connects with the first light source. The second clamping component includes a second clamping portion. The first clamping portion is configured to lean against the front surface and the second clamping portion is configured to lean against the back surface when the clamping lamp clamps the monitor, such that the first light source is located above the top surface and the second light source is located below the top surface. The first light source is configured to emit light toward a first zone that the front surface faces toward when the first light source is turned on. The second light source is configured to emit light toward a second zone that the back surface faces toward when the second light source is turned on. The second light source is disposed inside the second clamping component, and the second clamping component further includes a light-transmitting cover configured to cover the second light source and to allow light emitted by the second light source to pass through.

According to a third aspect of the present invention, a light controlling method applying the clamping lamp according to the first aspect is provided. The light controlling method comprises making the clamping lamp clamp the monitor; sensing a illuminance value of an environment where the monitor is used; calculating a luminous intensity of the first light source according to the illuminance value of the environment; controlling the first light source to emit light toward the first zone that the front surface faces toward; determining whether an illuminance value of the first zone meets a predetermined threshold or not; controlling the second light source to emit light toward the second zone that the back surface faces toward if the predetermined threshold is met; sensing a distance between the back surface and a reference object that the back surface faces toward; controlling a luminous intensity of the second light source according to the distance to make the luminous intensity of the second light source have a positive correlation with the distance; and calculating the luminous intensity of the first light source according to the illuminance value of the first zone if the predetermined threshold is not met.

The invention will become apparent from the following detailed description of the preferred but non-limiting embodiments. The following description is made with reference to the accompanying drawings.

DETAILED DESCRIPTION OF THE INVENTION

Figure 1:
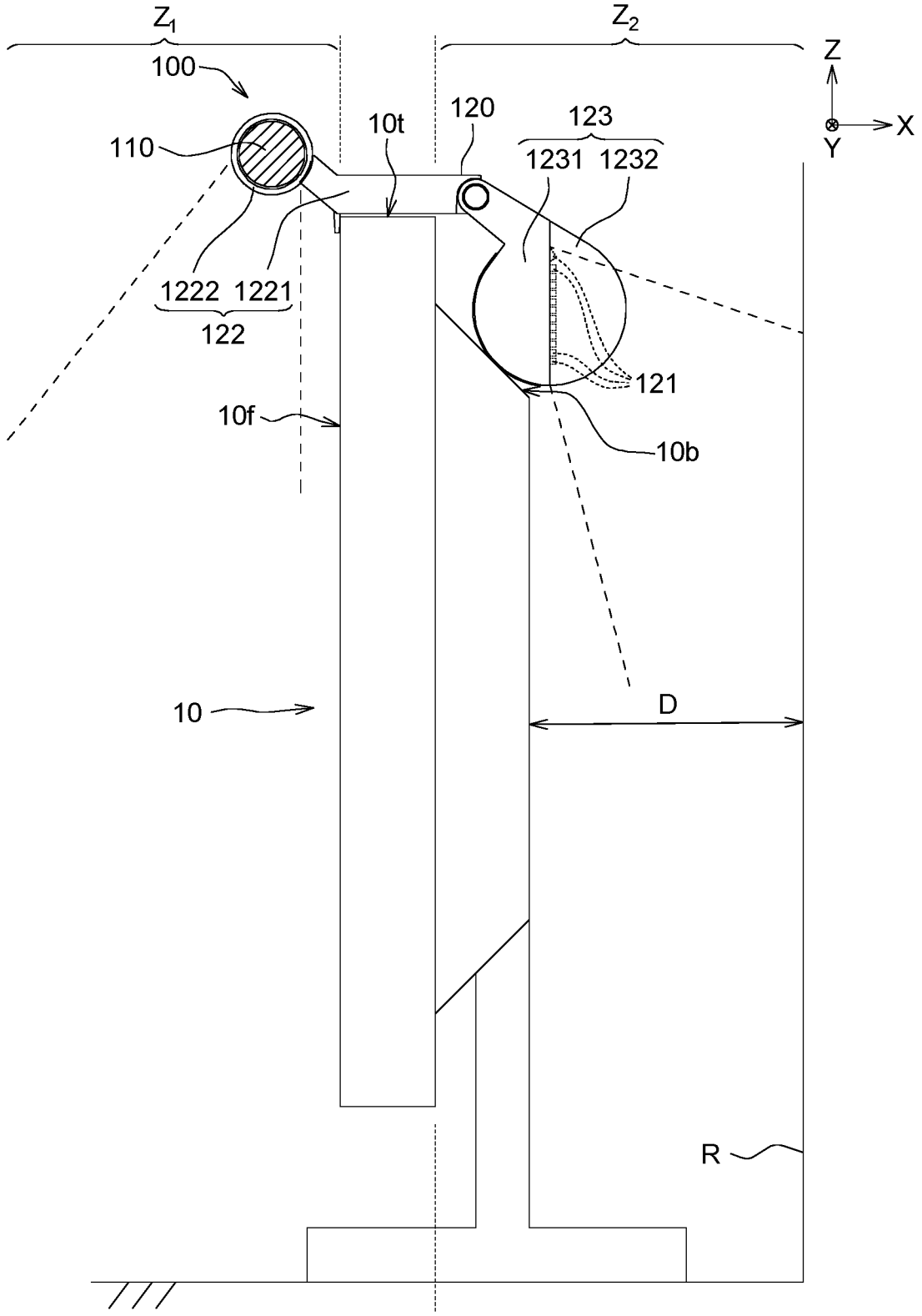
FIG. 1 is a side view showing that a clamping lamp according to an embodiment of the present invention is disposed on a monitor.
Figure 2:
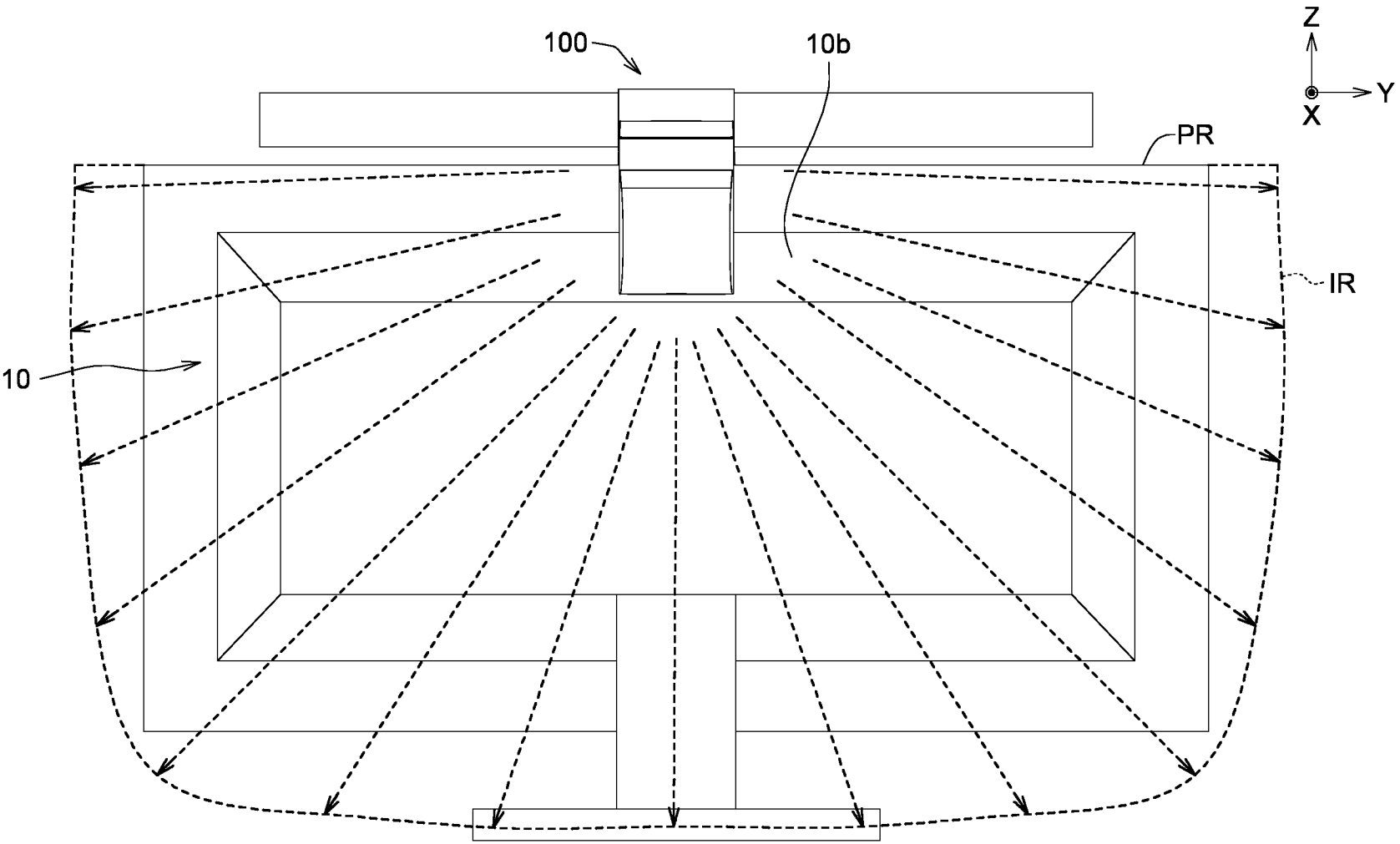
FIG. 2 is a back view showing that the clamping lamp according to the embodiment of the present invention is disposed on the monitor.

Please refer to FIG. 1 and FIG. 2. FIG. 1 is a side view showing that a clamping lamp 100 according to an embodiment of the present invention is disposed on a monitor 10, and FIG. 2 is a back view showing that the clamping lamp 100 according to the embodiment of the present invention is disposed on the monitor 10.

The monitor 10 has a front surface 10*f*, a back surface 10*b* and a top surface 10*t*, and the top surface 10*t* connects with the front surface 10*f* and the back surface 10*b*. The clamping lamp 100 comprises a first light source 110 and a clamping body 120. The clamping body 120 comprises a second light source 121, a first clamping component 122 and a second clamping component 123. The first clamping component 122 includes a first clamping portion 1221 and a lamp connection portion 1222, and the lamp connection portion 1222 connects with the first clamping portion 1221. The first light source 110 connects with the lamp connection portion 1222, and the first light source 110 may be pivoted relative to the lamp connection portion 1222 to adjust the light-emitting angle of the first light source 110. The second clamping component 123 includes a second clamping portion 1231. In an embodiment, the first clamping portion 1221 and the second clamping portion 1231 are movably connected, for example, they may move relatively through a hinge or a sliding manner. In an embodiment, the second light source 121 may be optionally disposed on the second clamping portion 1231; however, the second light source 121 may also be disposed on the first clamping portion 1221 if the length of the structure of the clamping body 120 is changed (for example, the first clamping portion 1221 is extended to the back surface 10*b* or the second light source 121 is changed to a structure that is able to adjust the emitting direction.

As shown in FIG. 1, the first clamping portion 1221 is configured to lean against the front surface 10*f* and the second clamping portion 1231 is configured to lean against the back surface 10*b* when the clamping lamp 100 clamps the monitor 10, such that the first light source 110 may be located above the top surface 10*t* and the second light source 121 may be located below the top surface 10*t*, wherein the Z axis in the FIG. 1 represents the reference direction of up and down. The front surface 10*f* of the monitor 10 faces toward a first zone Z1 to provide a display screen for users. The first light source 110 of the clamping lamp 100 is configured to emit light toward the first zone Z1 to provide illumination in front of the monitor 10 when the first light source 110 of the clamping lamp 100 is turned on. The back surface 10*b* of the monitor 10 faces toward a second zone Z2 and is separated from a reference object (such as a wall R) that is in the second zone Z2 by a distance D. The second light source 121 of the clamping body 120 is configured to emit light toward the second zone Z2 to provide illumination behind the monitor 10 when the second light source 121 is turned on.

It should be noted that when the environment where the monitor 10 is used is darker, if the illumination is only provided in the first zone Z1, there is a great brightness difference between the front and rear of the monitor 10, thereby causing that human eyes are stimulated too much and human eyes are easy to fatigue. Compared with the condition that the illumination is only provided in the first zone Z1, the condition that the first light source 110 of the clamping lamp 100 emits light in the first zone Z1 and the second light source 121 of the clamping body 120 emits light in the second zone Z2 at the same time can reduce the brightness difference between the front and rear of the monitor 10, thereby relieving the discomfort for human eyes to the light-dark contrast.

The first light source 110 is designed to be located above the top surface 10*t* of the monitor 10 in order to provide illumination in the main reading zone (i.e. the first zone Z1) and prevent the display screen of the monitor 10 from be blocked. The second light source 121 is configured to supplement light to reduce the brightness difference behind the monitor 10 (i.e. the second zone Z2), so the position of the second light source 121 is designed to be located below the top surface 10*t* of the monitor 10. In response to that the first light source 110 is used in a reading environment with higher brightness requirements, the luminous intensity of the first light source 110 should be set higher than the luminous intensity of the second light source 121, and the luminous intensity of the first light source 110 is proportional to the luminous intensity of the second light source 121.

As shown in FIG. 1, the second clamping component 123 may optionally includes a light-transmitting cover 1232, the light-transmitting cover 1232 is configured to cover the second light source 121 such that the second light source can be disposed inside the second clamping component 123, thereby protecting the second light source 121 from damage due to contact with the external environment. Also, the light-transmitting cover 1232 has light-transmittance to allow light emitted by the second light source 121 to pass through. Therefore, the light-transmitting cover 1232 does not affect the lighting behind the monitor 10 and can also provide waterproof and dustproof function.

As shown in FIG. 2, an illumination field IR of the second light source 121 is broader than a contour PR of the back surface 10*b* of the monitor 10, so as to effectively reduce the brightness difference between the front and rear of the monitor 10. On the contrary, if the illumination field IR is too narrow, most of light emitted by the second light source 121 will be blocked by the back surface 10*b* of the monitor 10, thereby failing to form an effective light supplement.

Figure 3:
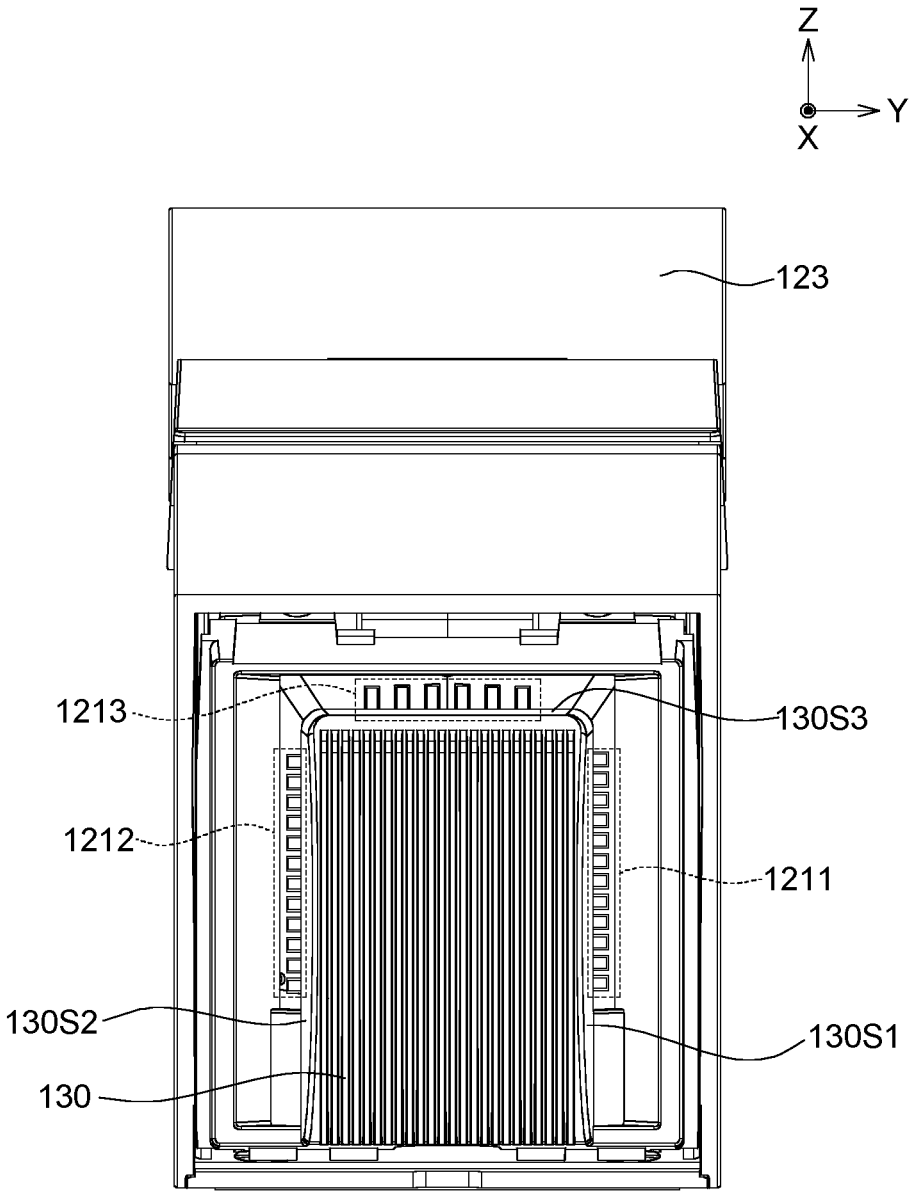
FIG. 3 is a back view showing some components of the clamping lamp according to the embodiment of the present invention.
Figure 4:
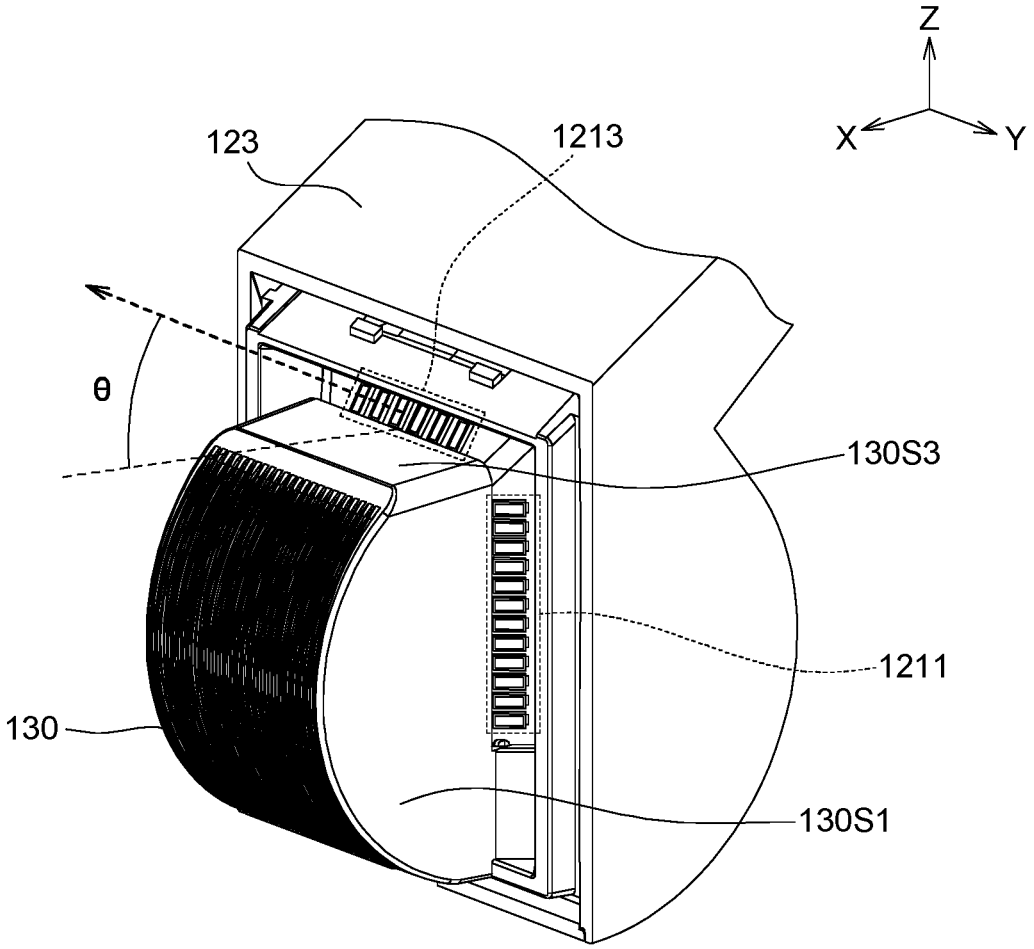
FIG. 4 is a 3D diagram showing some components of the clamping lamp according to the embodiment of the present invention.

Please refer to FIG. 1 and FIG. 2. FIG. 3 is a back view showing the second clamping component 123 and the second light source 121 of the clamping lamp 100 according to the embodiment of the present invention. FIG. 4 is a 3D diagram showing the second clamping component 123 and the second light source 121 of the clamping lamp 100 according to the embodiment of the present invention.

It should be noted that the light-transmitting cover 1232 of FIG. 1 is omitted in FIG. 3 and FIG. 4 in order to clearly show the internal configuration of the second clamping component 123. As shown in FIG. 3, the second light source 121 includes a first light-emitting array 1211, a second light-emitting array 1212 and a third light-emitting array 1213. The first light-emitting array 1211 is arranged in parallel with the second light-emitting array 1212. One end of the third light-emitting array 1213 is connected with the first light-emitting array 1211, and the other end of the third light-emitting array 1213 is connected with the second light-emitting array 1212. Specifically, the clamping lamp 100 further includes a weight component 130 disposed inside the second clamping component 123. The first light-emitting array 1211 and the second light-emitting array 1212 are respectively arranged on two sides of the weight component 130, namely arranged on the first side surface 130*s*1 and the second side surface 130*s*2. The third light-emitting array 1213 is arranged on a side connected between said two sides of the weight component 130, namely a third side surface 130*s*3. In other words, the third light-emitting array 1213 is disposed between the first light-emitting array 1211 and the second light-emitting array 1212. The third light-emitting array 1213 may be, but is not limited to, perpendicular to the first light-emitting array 1211 and the second light-emitting array 1212 to form a U-shaped arrangement. The first light-emitting array 1211 is configured to emit light on the right side facing toward the front surface 10*f* of the monitor 10, the second light-emitting array 1212 is configured to emit light on the left side facing toward the front surface 10*f* of the monitor 10, and the third light-emitting array 1213 is configured to emit light on the upper side facing toward the front surface 10*f* of the monitor 10. As such, supplementary lighting is provided around the rear of the monitor 10.

As shown in FIG. 4, the light-emitting direction of the third light-emitting array 1213 has an angle θ with the adjacent third side surface 130*s*3 of the weight component 130. Also, the light-emitting directions of the first light-emitting array 1211 and the second light-emitting array 1212 respectively has an angle θ with the adjacent first side surface 130*s*1 and second side surface 130*s*2 of the weight component 130. If the angle θ is about 90 degrees, the first light-emitting array 1211 and the second light-emitting array 1212 directly faces toward the left and right zones of the monitor 10 to emit light, and the third light-emitting array 1213 directly faces toward the upper zone of the monitor 10, such that the effect of the supplementary lighting behind the monitor 10 is much weaker and light emitted by the second light source 121 will direct to eyes of people who pass by or are in the left and right zones of the monitor 10. Thus, preferably, the angle θ is designed to be acute, such that the first light-emitting array 1211, the second light-emitting array 1212 and the third light-emitting array 1213 emit light toward the rear and the two sides of the monitor 10. Compared with the condition that the angle θ is not acute, this design can provide a better supplementary lighting behind the monitor 10 and avoid that light emitted by the second light source 121 directs to eyes of people who pass by or are in the left and right zones of the monitor 10.

Figure 5:
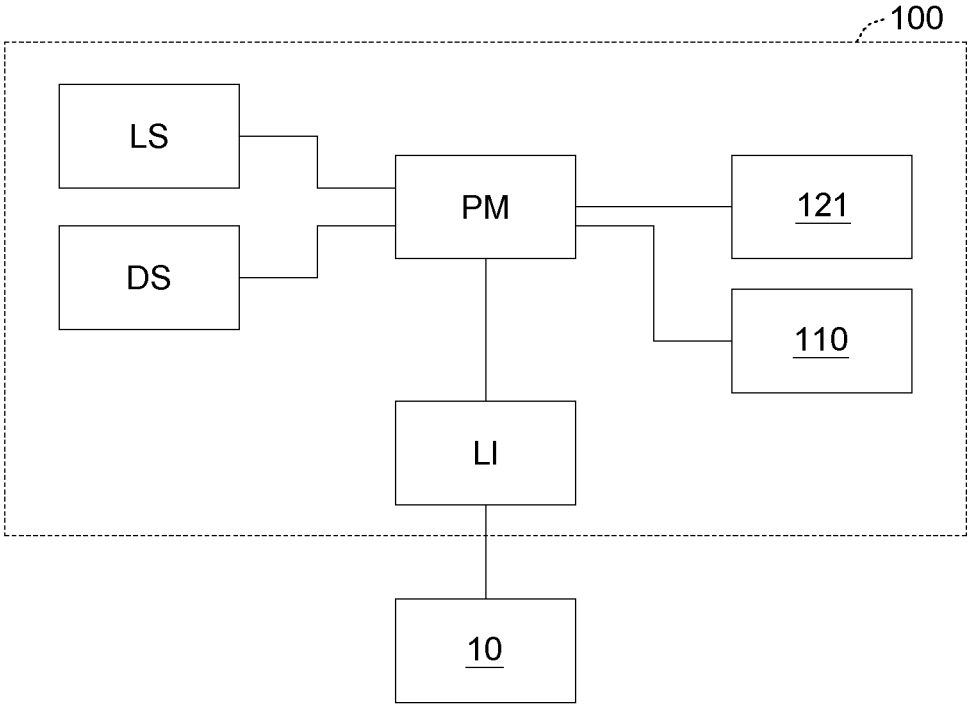
FIG. 5 is a function block diagram showing some components of the clamping lamp according to the embodiment of the present invention.

FIG. 5 is function block diagram showing some components of the clamping lamp 100 according to the embodiment of the present invention. The clamping lamp 100 may further comprises a light sensor LS, a distance sensor DS, a processing module PM and a lamp interface LI. The light sensor LS can be disposed outside the clamping lamp 100 to sense the illuminance value of the first zone Z1, and the processing module PM connects with the light sensor LS and configured to control the luminous intensity of the second light source 121 according to the illuminance value of the first zone Z1 so as to make the illuminance value of the second zone Z2 lower than the illuminance value of the first zone Z1. In an embodiment, the processing module PM may control the luminous intensity of the second light source 121 so as to make the illuminance value of the second zone Z2 approximately one-third of the illuminance value of the first zone Z1. That is, the illuminance value of the first zone Z1 is about 3 times the illuminance value of the second zone Z2, thereby achieving a range of illuminance difference that human eyes are uneasy to be fatigued.

The distance sensor DS may be disposed outside the clamping lamp 100. The distance sensor DS is configured to sense the distance D between the back surface 10*b* of the monitor 10 and the wall R when the clamping lamp 100 clamps the monitor 10, the processing module PM is configured to control the luminous intensity of the second light source 121 according to the distance D. Specifically, the distance D and the luminous intensity of the second light source 121 have a positive correlation. If the distance D is greater, the brightness of the light reflected by the wall R becomes weaker. Therefore, the luminous intensity of the second light source 121 must be increased to maintain the front and back of the monitor 10. Conversely, if the distance D is smaller, the brightness of the light reflected by the wall R is stronger, so the luminous intensity of the second light source 121 can be reduced. By adjusting the luminous intensity of the second light source 121 according to the distance D between the back surface 10*b* of the monitor 10 and the reference object, a suitable lighting environment may be provided.

The clamping lamp 100 can connect to an interface of the monitor 10 via the lamp interface LI to receive a setting value relevant to a real-time display screen of the monitor 10. For example, the lamp interface LI and the interface of the monitor 10 are Universal Serial Bus. For example, the setting value is the brightness, color temperature, sharpness, contrast and other parameter settings of the current display screen. The processing module PM may control the luminous intensity and color value of the first light source 110 and the second light source 121 according to this setting value. As such, the lighting adjustment can be performed based on the display information of the real-time display screen of the monitor 10, and the lighting control adapted to the display situation of the display screen of the monitor 10 is automatically provided. In an embodiment, the clamping lamp 100 may be adapted to connect with the interface of the monitor 10 to obtain the brightness value of the display screen of the monitor 10. The processing module PM may be configured to turn off the first light source 110. That is, the processing module PM can correspondingly adjust the luminous intensity of the second light source 121 according to the brightness value of the display screen of the monitor 10 without turning on the first light source 110, so as to achieve that the second light source 121 can be independently controlled relative to the first light source 110. Moreover, the brightness value of the above-mentioned display screen is not limited to be obtained and adjusted by connecting with the interface of the monitor 10, and can also be obtained directly through the clamping lamp 100. For example, it can be obtained by the clamping lamp 100 namely a button switch included in the clamping lamp 100. The internal setting value about display screen included in the clamping lamp 100 can be obtained and the brightness value can be adjusted.

Specifically, to describe with respect to the first light-emitting array 1211, the second light-emitting array 1212 and the third light-emitting array 1213 in FIG. 3 and FIG. 4, the setting value includes a first setting value, a second setting value and a third setting value; the first setting value, the second setting value and the third setting value respectively correspond to a right area, a left area and an upper area of the real-time display screen; the first set value, the second set value and the third setting value respectively correspond to the first light-emitting array 1211, the second light-emitting array 1212 and the third light-emitting array 1213; and the processing module PM respectively sets the luminous intensity and the color value of the first light-emitting array 1211, the second light-emitting array 1212 and the third light-emitting array 1213 according to the first setting value, the second setting value and the third setting value. For example, if the brightness value of the right area of the real-time display screen corresponding to the monitor 10 is too low or too high, the processing module PM controls the corresponding first light-emitting array 1211 to lower or to increase the luminous intensity to reduce the brightness difference between the monitor 10 and the environment. In the same way, the corresponding third light-emitting array 1213 and second light-emitting array 1212 can be individually controlled to adjust the luminous intensity according to the brightness value of the upper area of the left area of the real-time display screen of the monitor 10. As such, each light-emitting array can be controlled to match the corresponding area of the display screen, so as to achieve a more precise and independent light controlling.

Figure 6:
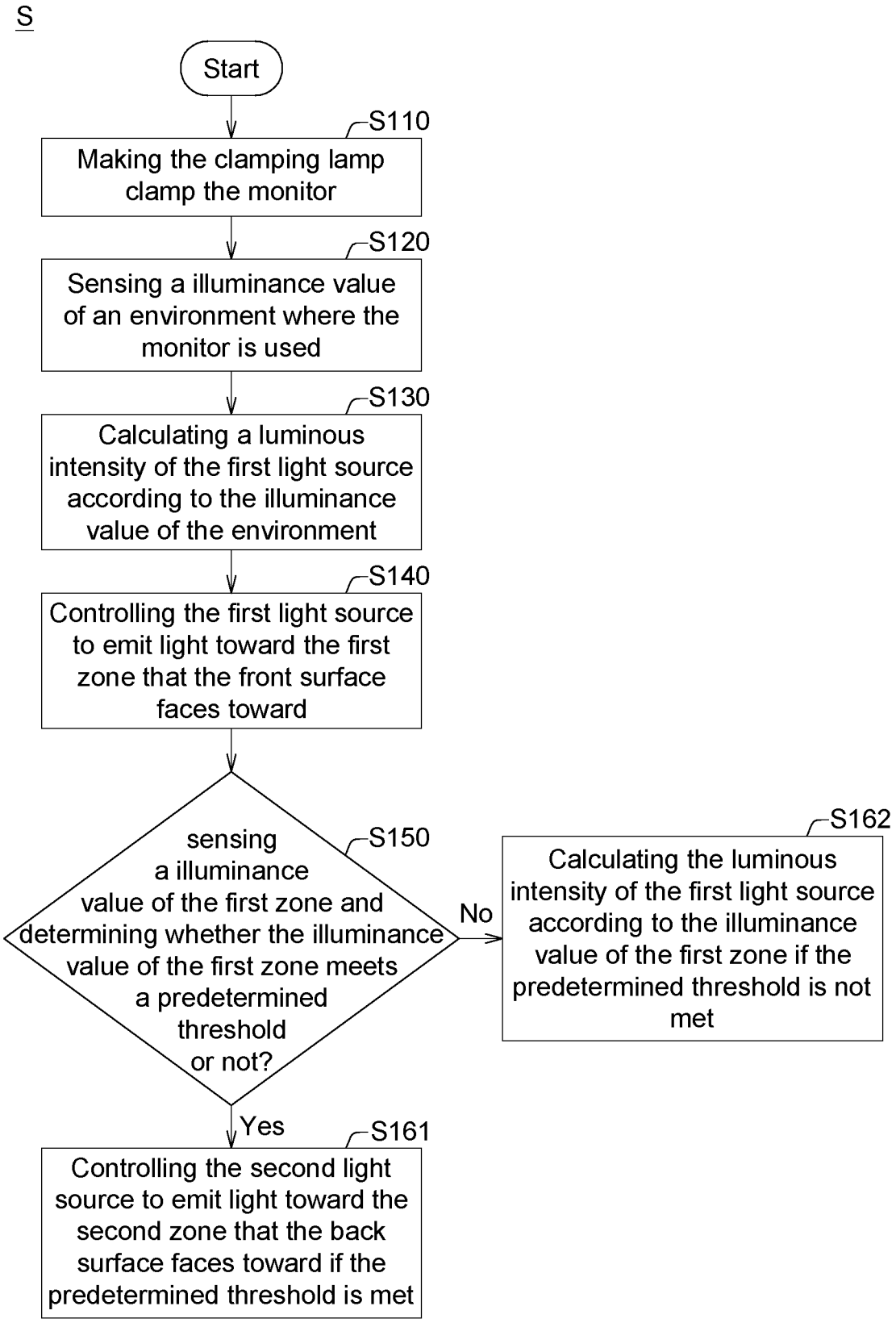
FIG. 6 is a flow chart showing steps for a light controlling method of the clamping lamp according to the embodiment of the present invention.

Please refer to FIG. 6. FIG. 6 is a flow chart showing steps for a light controlling method S of the clamping lamp 100 according to the embodiment of the present invention. In the step S110, making the clamping lamp 100 clamp the monitor is performed, so that the first light source 110 is located above the top surface 10*t* of the monitor 10, and the second light source 121 is located below the top surface 10*t* of the monitor 10.

In the step S120, sensing the illuminance value of the environment where the monitor 10 is used is performed. For example, the light sensor LS may be configured to sense, and the illuminance value of the environment is a comprehensive value referring the screen light from the display screen of the monitor 10 and the reflected light of the desktop that the monitor 10 is placed on, etc.

In the step S130, calculating the luminous intensity of the first light source 110 according to the illuminance value of the environment is performed. For example, the luminous intensity required by the first light source 110 can be preliminarily calculated by the processing module PM to match the ambient illuminance of the general screen usage.

In step S140, controlling the first light source 110 to emit light toward the first zone Z1 that the front surface 10*f* faces toward is performed. For example, the processing module PM is configured to control the first light source 110 to emit light as the main lighting for the first zone Z1 that a user who faces toward the monitor 10 is in.

In the step S150, determining whether the illuminance value of the first zone Z1 meets a predetermined threshold or not is performed. For example, the illuminance value of the first zone Z1 may be sensed by the light sensor LS, and the determination may be performed by the processing module PM, and the predetermined threshold may be defined as about 500 lux, which is the recommended brightness for general screen usage.

In the step S161, controlling the second light source 121 to emit light toward the second zone Z2 that the back surface 10*b* faces toward if the predetermined threshold is met is performed. For example, the second light source 121 may be controlled to emit light by the processing module PM, so as to reduce the brightness difference between the front and the back of the monitor 10 and provide a supplementary lighting. Specifically, the processing module PM may control the luminous intensity of the second light source 121 so that the illuminance value of the second zone Z2 is approximately one-third of the illuminance value of the first zone Z1, which is designed to make the eyes less fatigued. For example, if the first zone Z1 reaches about 500 lux, the illuminance value of the second zone Z2 is controlled to be about 170 lux.

In the step S162, calculating the luminous intensity of the first light source 110 according to the illuminance value of the first zone Z1 if the predetermined threshold is not met is performed. For example, the luminous intensity required by the first light source 110 may be calculating again by the processing module PM to smartly adjust the luminous intensity in accordance with the current environment.

Further, making the luminous intensity of the first light source 110 higher than the luminous intensity of the second light source 121 and making the luminous intensity of the first light source 110 proportional to the luminous intensity of the second light source 120 may be performed by the processing module PM.

Further, controlling the luminous intensity of the second light source 121 according to the illuminance value of the first zone Z1 so as to make the illuminance value of the second zone Z2 lower than the illuminance value of the first zone Z1 may be performed by the processing module PM.

Further, controlling the luminous intensity of the second light source 121 to make the illuminance value of the second zone Z2 approximately one-third of the illuminance value of the first zone Z1 may be performed by the processing module PM.

Further, sensing the distance D between the back surface 10*b* and the wall R may be performed by the distance sensor DS, and controlling the luminous intensity of the second light source 121 according to the distance D may be performed by the processing module PM.

Further, controlling the luminous intensity of the second light source 121 to make the illuminance value of the second zone Z2 approximately one-third of the illuminance value of the first zone Z1 may be performed by the processing module PM.

Further, the clamping lamp 100 can be connected with the interface of the monitor 10 to obtain a display brightness value of the monitor 10, and controlling the luminous intensity of the second light source 121 according to the display brightness value may be performed by the processing module PM. The clamping lamp 100 can receive the setting value related to the real-time display screen of the monitor 10 through the connection with the monitor 10, and the processing module PM may control the brightness value and the color value of the second light source 121 according to the setting value.

According to the description of the above-mentioned embodiments, the first light source and the second light source of the clamping lamp clamping the monitor can emit light at the front and rear of the monitor at the same time, so as to reduce the brightness difference between the front and rear of the monitor. Compared with only a single light source emitting in the front of the monitor, the clamping lamp of the present invention can make human eyes less fatigued when using the monitor and achieve a beneficial effect of eye protection.

While the invention has been described and illustrated with reference to specific embodiments thereof, these descriptions and illustrations do not limit the invention. It should be understood by those skilled in the art that various changes may be made and equivalents may be substituted without departing from the true spirit and scope of the invention as defined by the appended claims. The illustrations may not necessarily be drawn to scale. There may be distinctions between the artistic renditions in the present disclosure and the actual apparatus due to manufacturing processes and tolerances. There may be other embodiments of the present invention which are not specifically illustrated. The specification and the drawings are to be regarded as illustrative rather than restrictive. Modifications may be made to adapt a particular situation, material, composition of matter, method, or process to the objective, spirit and scope of the invention. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the invention. Accordingly, unless specifically indicated herein, the order and grouping of the operations are not limitations of the invention.

What is claimed is:

1. A clamping lamp for clamping a monitor, wherein the monitor has a front surface, a back surface, and a top surface connecting with the front surface and the back surface, and the clamping lamp comprises:

a first light source; and a clamping body comprising:

a second light source;

a first clamping component including a first clamping portion and a lamp connection portion connecting with the first clamping portion, wherein the lamp connection portion connects with the first light source; and a second clamping component including a second clamping portion;

wherein the first clamping portion is configured to lean against the front surface and the second clamping portion is configured to lean against the back surface when the clamping lamp clamps the monitor, such that the first light source is located above the top surface and the second light source is located below the top surface;

wherein the first light source is configured to emit light toward a first zone that the front surface faces toward when the first light source is turned on, and the second light source is configured to emit light toward a second zone that the back surface faces toward when the second light source is turned on;

wherein the second light source includes a first light-emitting array, a second light-emitting array and a third light-emitting array; the third light-emitting array is disposed between the first light-emitting array and the second light-emitting array; the third light-emitting array is not parallel with the first light-emitting array and the second light-emitting array.

2. The clamping lamp according to claim 1, wherein the monitor has a top side, a first lateral side and a second lateral side, the third light-emitting array is closer to the top side than the first light-emitting array and the second light-emitting array.

3. The clamping lamp according to claim 2, wherein a first end of the third light-emitting array is connected with the first light-emitting array, and a second end of the third light-emitting array is connected with the second light-emitting array.

4. The clamping lamp according to claim 3, wherein the third light-emitting array is parallel with the top side, the first light-emitting array and the second light-emitting array are parallel with the first lateral side.

5. The clamping lamp according to claim 2, wherein the first light-emitting array is parallel with the first lateral side and a light-emitting direction of the first light-emitting array has an acute angle with the back surface of the monitor; the second light-emitting array is parallel to the second lateral side and a light-emitting direction of the second light-emitting array has an acute angle with the back surface of the monitor.

6. The clamping lamp according to claim 1, further comprising:

an light sensor configured to sense an illuminance value of the first zone; and a processing module connecting with the light sensor and configured to control the luminous intensity of the second light source according to the illuminance value of the first zone so as to make an illuminance value of the second zone lower than the illuminance value of the first zone.

7. The clamping lamp according to claim 6, further comprising:

a distance sensor disposed on the second clamping portion, wherein the distance sensor is configured to sense a distance between the back surface and a reference object that the back surface faces toward when the clamping lamp clamps the monitor, and the processing module is configured to control the luminous intensity of the second light source according to the distance to make the luminous intensity of the second light source have a positive correlation with the distance.

8. The clamping lamp according to claim 6, wherein the clamping lamp is adapted to connect with an interface of the monitor to obtain a display brightness value of the monitor, and the processing module is configured to control the luminous intensity of the second light source according to the display brightness value.

9. The clamping lamp according to claim 1, wherein the third light-emitting array is perpendicular to the first light-emitting array and the second light-emitting array to form a U-shaped arrangement, the opening of the U-shaped is downward.

10. The clamping lamp according to claim 1, wherein the first light-emitting array is arranged in parallel with the second light-emitting array; one end of the third light-emitting array is connected with the first light-emitting array; and the other end of the third light-emitting array is connected with the second light-emitting array.

11. The clamping lamp according to claim 10, wherein the clamping lamp further includes a weight component; the first light-emitting array and the second light-emitting array are respectively arranged on two sides of the weight component, the third light-emitting array is arranged on a top side of the weight component; a light-emitting direction(s) of the first light-emitting array, the second light-emitting array and/or the third light-emitting array has an angle with an adjacent side surface of the weight component; and the angle is acute, the light-emitting directions of the first light-emitting array and the second light-emitting array are different.

12. The clamping lamp according to claim 1, wherein light-emitting directions of the first light-emitting array and the second light-emitting array are different.

13. A clamping lamp for clamping a monitor, wherein the monitor has a front surface, a back surface, and a top surface connecting with the front surface and the back surface, and the clamping lamp comprises:

a first light source;

a clamping body comprising:

a second light source;

a first clamping component including a first clamping portion and a lamp connection portion connecting with the first clamping portion, wherein the lamp connection portion connects with the first light source; and a second clamping component including a second clamping portion;

a lamp interface configured to connect with an interface of the monitor to receive a setting value; and a processing module configured to control the luminous intensity and a color value of the second light source according to the setting value, wherein the setting value is relevant to a real-time display screen of the monitor;

wherein the first clamping portion is configured to lean against the front surface and the second clamping portion is configured to lean against the back surface when the clamping lamp clamps the monitor, such that the first light source is located above the top surface and the second light source is located below the top surface;

wherein the first light source is configured to emit light toward a first zone that the front surface faces toward when the first light source is turned on, and the second light source is configured to emit light toward a second zone that the back surface faces toward when the second light source is turned on;

wherein a plane formed by a periphery of the second clamping portion that is adjacent to the second light source is substantially parallel to the front surface when the clamping lamp clamps the monitor;

wherein the second light source includes a first light-emitting array, a second light-emitting array and a third light-emitting array; the third light-emitting array is disposed between the first light-emitting array and the second light-emitting array; the third light-emitting array is perpendicular to the first light-emitting array and the second light-emitting array; the setting value includes a first setting value, a second setting value and a third setting value; the first setting value, the second setting value and the third setting value respectively correspond to a right area, a left area and an upper area of the real-time display screen; the first set value, the second set value and the third setting value respectively correspond to the first light-emitting array, the second light-emitting array and the third light-emitting array; and the processing module respectively sets the luminous intensity and the color value of the first light-emitting array, the second light-emitting array and the third light-emitting array according to the first setting value, the second setting value and the third setting value.

14. A clamping lamp for clamping a monitor, wherein the monitor has a front surface, a back surface, and a top surface connecting with the front surface and the back surface, the monitor displays a real-time image, and the clamping lamp comprises:

a first light source; and a clamping body comprising:

a second light source comprising a first light-emitting array and a second light-emitting array;

a first clamping component including a first clamping portion and a lamp connection portion connecting with the first clamping portion, wherein the lamp connection portion connects with the first light source;

a second clamping component including a second clamping portion;

a lamp interface configured to connect with an interface of the monitor to receive a setting value, the setting value comprising a first setting value and a second setting value respectively correspond to a right area and a left area of the real-time image; and a processing module setting the luminous intensity and the color value of the first light-emitting array and the second light-emitting array with the first setting value and the second setting value respectively;

wherein when the clamping lamp clamps the monitor, the first light source is configured to emit light toward a first zone that the front surface faces toward when the first light source is turned on, and the second light source is configured to emit light toward a second zone that the back surface faces toward when the second light source is turned on.

15. A light controlling method applying the clamping lamp according to claim 7, comprising:

making the clamping lamp clamp the monitor;

sensing a illuminance value of an environment where the monitor is used;

turning off the first light source;

calculating a luminous intensity of the first light source according to the illuminance value of the environment;

controlling the first light source to emit light toward the first zone that the front surface faces toward;

determining whether an illuminance value of the first zone meets a predetermined threshold or not;

controlling the second light source to emit light toward the second zone that the back surface faces toward if the predetermined threshold is met;

sensing a distance between the back surface and a reference object that the back surface faces toward;

controlling a luminous intensity of the second light source according to the distance to make the luminous intensity of the second light source have a positive correlation with the distance; and calculating the luminous intensity of the first light source according to the illuminance value of the first zone if the predetermined threshold is not met.

16. The light controlling method according to claim 15, further comprising:

making the luminous intensity of the first light source higher than the luminous intensity of the second light source; and making the luminous intensity of the first light source proportional to the luminous intensity of the second light source.

17. The light controlling method according to claim 15, further comprising:

sensing the illuminance value of the first zone; and controlling the luminous intensity of the second light source according to the illuminance value of the first zone so as to make an illuminance value of the second zone lower than the illuminance value of the first zone.

18. The light controlling method according to claim 15, further comprising:

connecting the clamping lamp with an interface of the monitor to obtain a display brightness value of the monitor; and controlling the luminous intensity of the second light source according to the display brightness value.

19. The light controlling method according to claim 15, further comprising:

receiving a first setting value and a second setting value respectively correspond to a right area and a left area of a real-time display screen of the monitor; and setting the luminous intensity and a color value of the first light-emitting array and the second light-emitting array with the first setting value and the second setting value respectively.

* * * * *